United States Patent [19]

Chu et al.

[11] 3,996,429

[45] Dec. 7, 1976

[54] MULTI-CONTACT PUSH-BUTTON SWITCH HAVING PLURAL PRESTRESSED CONTACT MEMBERS DESIGNED TO PROVIDE PLURAL CIRCUIT SIMULTANEOUS SWITCHING INPUTS

[75] Inventors: Pak-Jong Chu; Cornelis Wilfred Reedyk, both of Ottawa, Canada

[73] Assignee: Northern Electric Company Limited, Montreal, Canada

[22] Filed: Apr. 18, 1975

[21] Appl. No.: 569,359

[52] U.S. Cl. ..... 200/5 A; 200/1 R; 200/67 DB; 200/159 A; 200/159 B; 200/275

[51] Int. Cl.[2] ..... H01H 13/70; H01H 1/06; H01H 5/00

[58] Field of Search ..... 200/1 R, 5 R, 5 A, 67 D, 200/67 DA, 67 DB, 159 R, 159 A, 159 B, 160, 241, 242, 243, 275, 340

[56] References Cited

UNITED STATES PATENTS

| | | | |
|---|---|---|---|
| 3,133,170 | 5/1964 | Nanninga | 200/67 DB |
| 3,600,528 | 8/1971 | Leposavic | 200/159 B X |
| 3,699,294 | 10/1972 | Sudduth | 200/159 B X |
| 3,742,157 | 6/1973 | Leposavic | 200/159 B X |
| 3,761,944 | 9/1973 | Shimojo | 200/159 B X |
| 3,796,843 | 3/1974 | Durkee et al. | 200/159 B X |
| 3,800,104 | 3/1974 | Lien et al. | 200/159 A X |
| 3,826,882 | 7/1974 | Giolitti et al. | 200/67 DA |
| 3,870,840 | 3/1975 | Rivetta et al. | 200/159 A X |
| 3,898,421 | 8/1975 | Suzumura | 200/159 B |
| 3,941,953 | 3/1976 | Misson et al. | 200/5 R |
| 3,941,964 | 3/1976 | Yoder | 200/159 A |

*Primary Examiner*—James R. Scott
*Attorney, Agent, or Firm*—Sidney T. Jelly

[57] ABSTRACT

A push-button switch has a spring contact plate and a circuit board in superposed position. The spring contact plate has one or more switch positions, each switch position comprising a prestressed domed portion surrounded by a common flat sheet portion. The spring contacts of each prestressed dome portion selectively engage peripheral contact areas on the circuit board followed by the central contact portion engaging subsequently with a further fixed central contact area on the circuit board. Accordingly, plural inputs of electronic logic circuits may be preselected prior to simultaneous activation upon subsequent closure of the central contacts at a given switch position. Release of the push button enables the domed portion to snap back to the stable position.

3 Claims, 14 Drawing Figures

MULTI-CONTACT PUSH-BUTTON SWITCH HAVING PLURAL PRESTRESSED CONTACT MEMBERS DESIGNED TO PROVIDE PLURAL CIRCUIT SIMULTANEOUS SWITCHING INPUTS

This invention relates to multi-contact push-button switches, particularly to such switches having a snap-action.

Switches in accordance with the present invention are suitable for telephone sets and are particularly applicable to providing binary coded signals to operate on logic circuits in telephone sets and other forms of electrical and electronic apparatus.

It is a constant requirement that switches be made more compact, requiring a minimal space in the apparatus. At the same time the switch should be simple and reliable. In a telephone, and other apparatus, the push-button is actuated by users who may actuate the push-button with widely varying characteristics, which characteristics could influence the signal quality resulting from the switch actuation. The particular characteristics of the push-button, such as feedback, operating force and button travel are therefore important.

The present invention provides a push-button switch which has a snap-action which action positively ensures proper switch contact, and also gives a positive "feel" to the switch actuation. The push-button switch has a prestrained dome-shape spring contact plate. This contact plate undergoes the snap-action after a predetermined amount of applied force by the push-button, and snaps back after the removal of the force. In particular, the switch has a plurality of contacts spaced around a central point and a further contact at the central point. The closing of the central contact is delayed with respect to the closing of the plurality of contacts positioned around the central contact. This arrangement provides the facility of applying binary coded signals, derived from multiple contact closures, simultaneously to multiple inputs of electronic logic circuits upon closure of the central contact.

The particular details, advantages and actuation relating to these particular features, and to other features will be readily understood by the following description of certain embodiments, by way of example, in conjunction with the accompanying drawings, in which.

Figure 1:
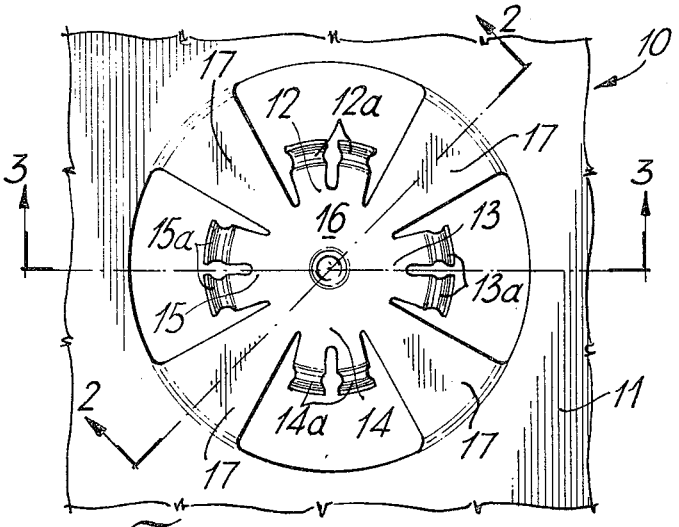
FIG. 1 is a plan view of one form of spring contact plate.
Figure 5:
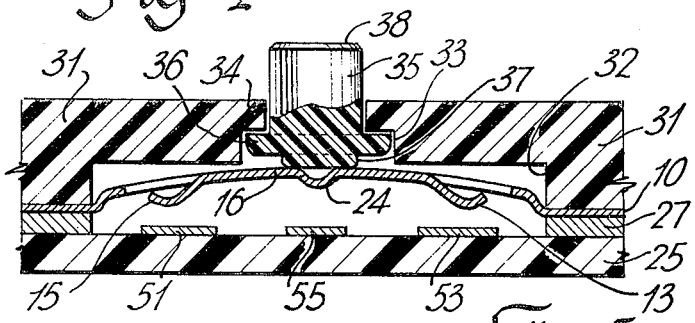
Figure 6:
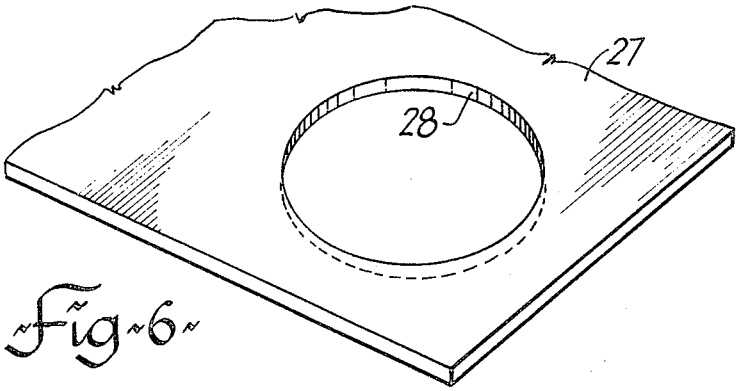
Figure 7:
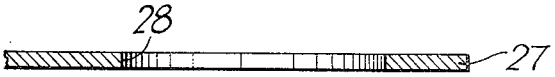
Figure 4A:
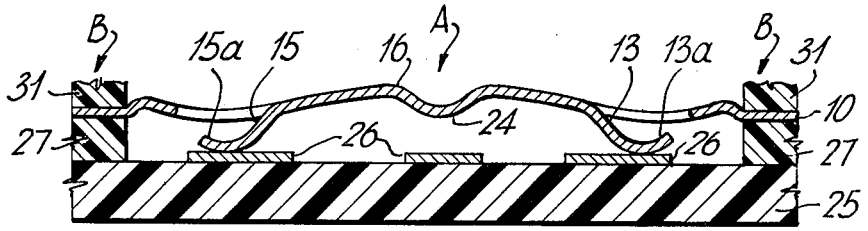
Figure 4B:
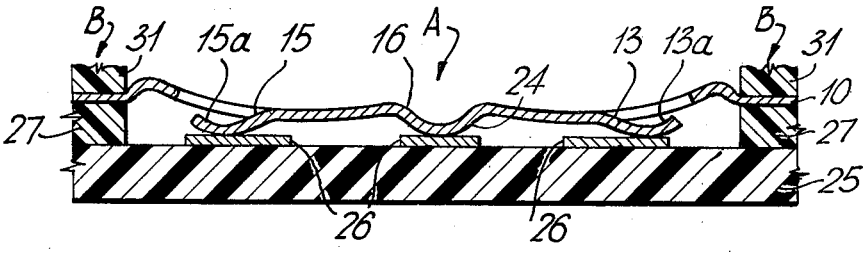
Figure 8:
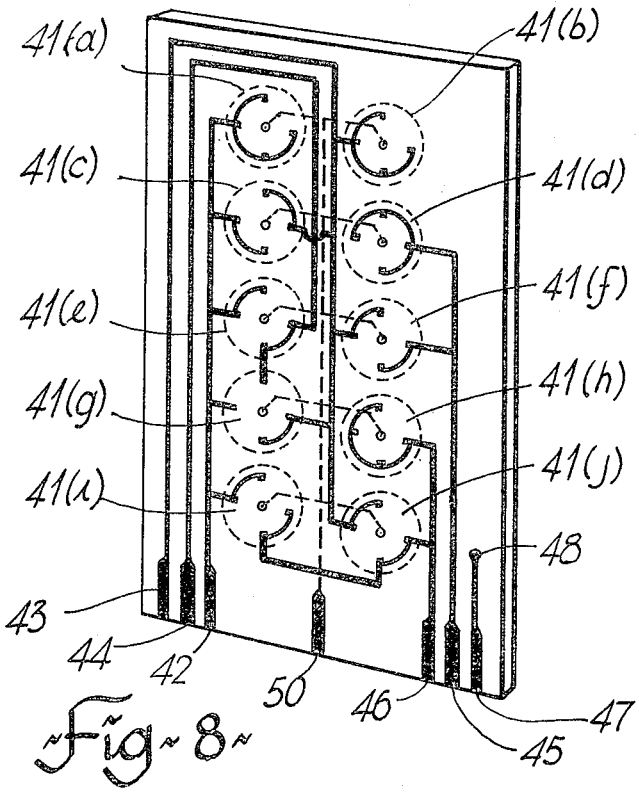
Figure 9:
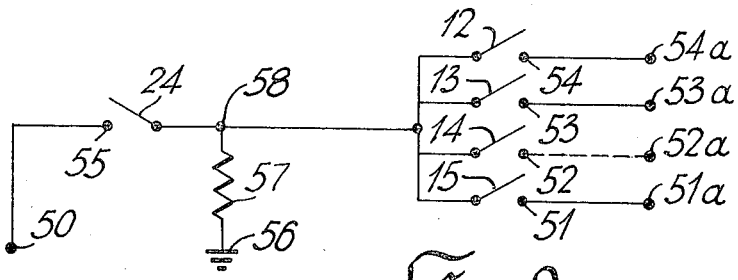
Figure 10A:
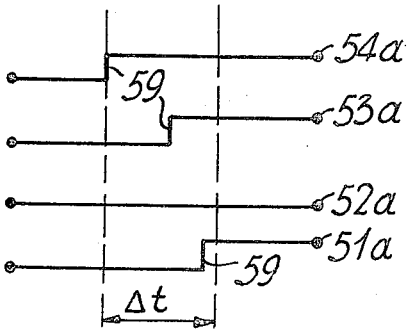
Figure 10B:
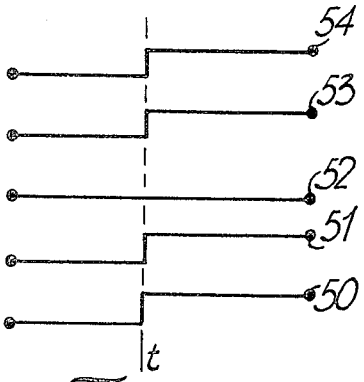
Figure 11:
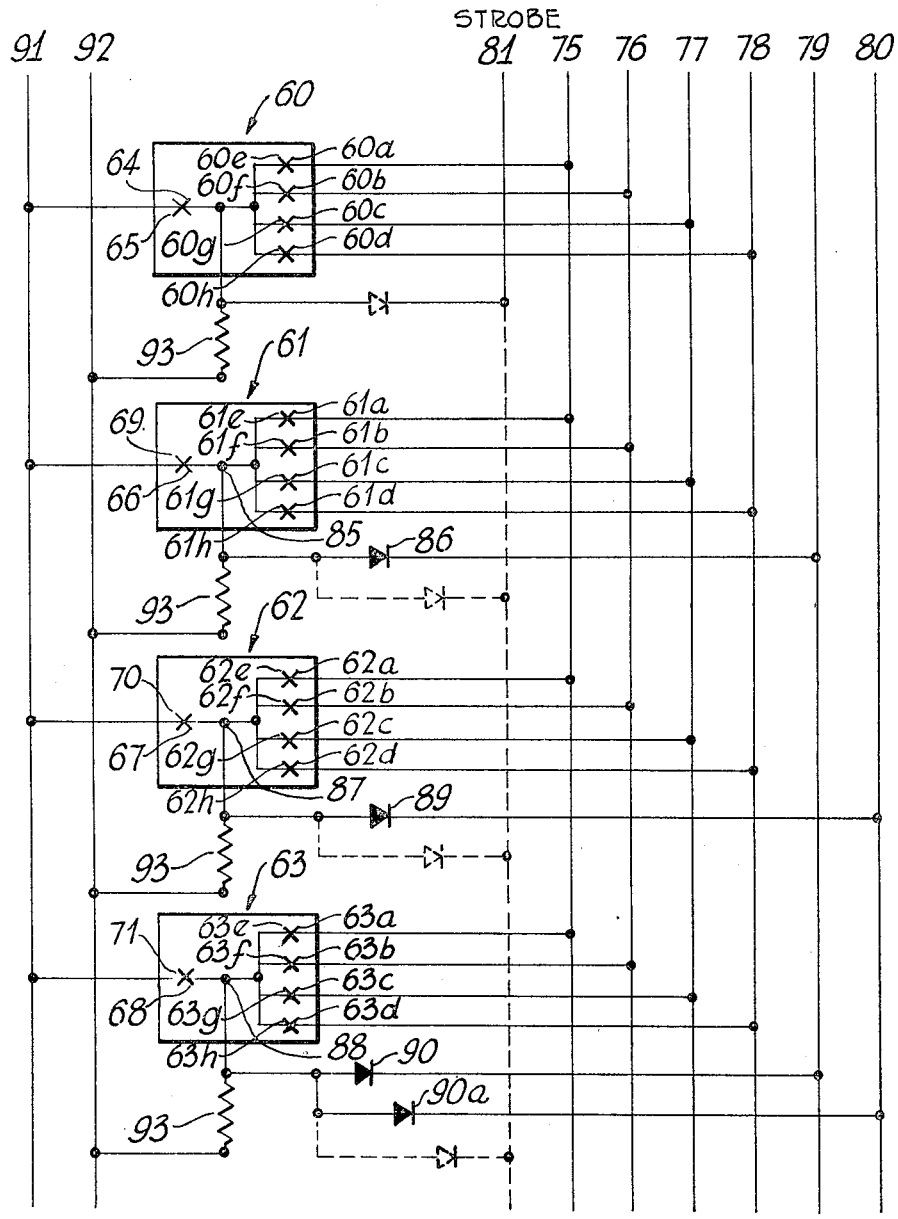
Figure 8A:
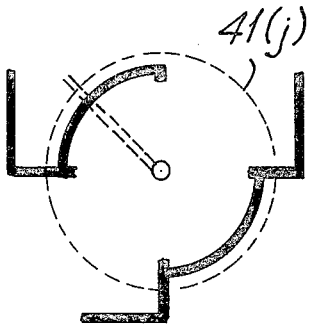

FIGS. 4*a* and 4*b* are cross-sections of the spring contact plate of FIG. 1, as on the line 3—3, but illustrating the contact plate in an intermediate condition and an actuated condition respectively;

FIG. 5 is a cross-section through a form of switch incorporating the contact plate of FIGS. 1 to 4;

FIG. 6 is a perspective view of a spacer as used in the switch of FIG. 5;

FIG. 7 is a plan view of the spacer of FIG. 6;

FIG. 8 is a perspective plan view of a printed circuit board on which is to be mounted a plurality of push-button switches of the form of FIG. 5;

FIG. 8*a* is an enlarged view of one switch position of FIG. 8;

FIG. 9 is a diagrammatic circuit diagram of a push-button switch as in FIG. 5;

FIGS. 10*a* and 10*b* indicate the time relationship of contact making and signal output of a switch as in FIG. 5;

FIG. 11 is a schematic circuit diagram for use with a plurality of push-button switches as in FIG. 5.

Figure 2:
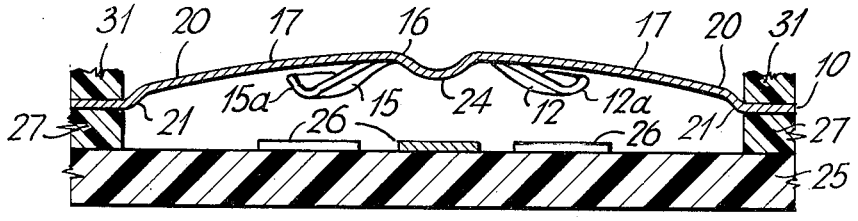
FIG. 2 is a cross-section on the line 2—2 of FIG. 1, and including additional parts.
Figure 3:
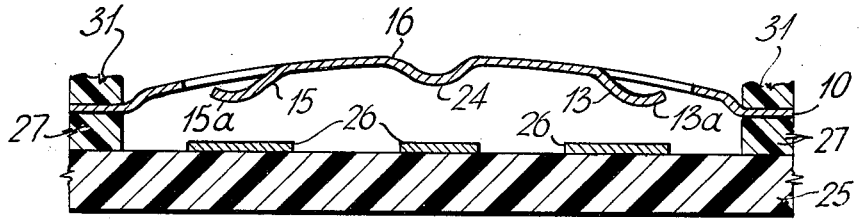
FIG. 3 is a cross-section on the line 3—3 of FIG. 1, and including additional parts.

As illustrated in FIGS. 1, 2 and 3, a spring contact plate 10 is in the form of a stamping, for example of stainless steel. There is a flat sheet portion 11 surrounding a contact portion which comprises four contacts 12, 13, 14 and 15. The contacts extend radially from a central portion 16 connected to the flat sheet portion 11 by radial connecting webs 17. The contacts 12, 13, 14 and 15, and central portion 16 and webs 17 are formed from the sheet portion 11 and are given a prestressed domed formation, as seen in FIGS. 2 and 3. The outer ends of the contacts 12 to 15 are formed to give downwardly extending rib formations — 12*a* – 15*a* respectively, these rib portions forming the actual contact areas.

When pressure is applied to the central portion, in a downward direction as seen in FIGS. 2 and 3, the center portion moves down with flexing of the webs 17. At a particular postion the center portion snaps down, still however having a residual stress tendency to return the center portion 17 to the normal position as in FIG. 2. The webs 17 each flex or buckle at a position 20 just radially inward from the junction portion 21 with the flat-sheet portion 11. It will be seen that these junction portions have an initial upward bend and the webs bend down again just inside the portions 21, as seen in FIG. 4. In the center of the central portion 16 an additional contact 24 is formed. This contact 24 is formed in the present example by a downwardly extending dimple. Also indicated in FIGS. 1 to 4 is a rigid base member 25, in the present example a printed circuit board having a printed circuit 26 thereon. An insulating spacer is indicated at 27 and part of a cover at 31. As the contacts 12*a* to 15*a* make contact with the related contact areas of the printed circuit 26 there is a radial wiping action by the contacts on the contact areas. This provides for good electrical contact between contacts 12*a* to 15*a* and the printed circuit 26.

The snap-action, and return force, of the contact plate 10 can vary depending upon the particular design. Thus a domed plate can be arranged to have a bistable condition, being stable in a non-deflected condition, as in FIGS. 2 and 3 for example, and also being stable in a fully deflected condition. Such a plate would not have any return force present to restore the plate to a non-deflected condition. In such an arrangement, the printed circuit board 25 is positioned relative to the contact plate 10, by spacer 27, such that the central portion 16 is unable to deflect down sufficiently to reach its alternative stable state. The central portion will always snap back on release of the operating force, exemplified by the arrow A in FIGS. 4*a* and 4*b*.

It is also possible to design the contact plate 10 such that the central portion 16 has only one stable condition — the undeflected condition as in FIGS. 2 and 3. The contact plate 10 of FIGS. 1 to 4 is conveniently of this type, the single stable state created by the particular formation of the upwardly bent junction portion 21. This provides a positive return force on the central portion at all times, although the central portion will snap down under pressure at the center. Other formations for ensuring a positive return force at all times can be provided.

A further effect on the snap-action and return force is provided by the clamping of the flat portion 11 of the conact plate 10, surrounding the domed portion. Clamping pressure, indicated by arrows B in FIGS. 4*a* and 4*b*, affect the return force and can alter a bistable contact plate to a monostable contact plate, when clamped.

At first, as seen in FIG. 4*a*, the contacts 12, 13 14 and 15 make contact with the printed circuit board 25. The order in which these contacts are made is indeterminable because of manufacturing tolerances. Contact is not likely to occur simultaneously for all contacts and further, the sequence of contact is not necessarily the same each time the contact plate is actuated. It is emphasized that FIG. 4*a* illustrates a transitory stage only, the contact plates does not stay in this condition but moves rapidly to the condition of FIG. 4*b*.

FIG. 5 illustrates one form of switch including a contact plate as illustrated in FIGS. 1 to 4. The switch comprises the printed circuit board 25, insulating spacer 27, the spring contact plate 10 and a cover 31. As seen in FIGS. 6 and 7 the spacer 27 is of flat material having a circular hole 28 therein. The hole 28 is aligned with the domed portion of the contact plate 10.

In the switch illustrated in FIG. 5, the cover 31 is recessed at 32 to clear the contact plate 10 and also has a further recess 33 and a bore 34. Positioned in the bore 34 is a push button 35 having a radially extending flange 36 on its lower end. The flange 36 moves axially in the recess 33. On the lower end of the push button is a protrusion 37 which resets on the central portion 16 of the contact plate 10.

Pressure on the upper end 38 of the push button 35 depresses the central portion 16 of the contact plate. After a short movement of the push button there is a snap action, contacts 12 to 15 first moving into contact with the conductors on the printed circuit board 25 — as illustrated in FIG. 4*a*, and then center contact 24 making contact with its related conductor on the board, as illustrated in FIG. 4*b*. The push button maintains a follow-up movement under pressure from the users finger. There is a distinct "feedback" to the user, who feels the snap-action and sudden movement. On release of the push button, the central portion 16 snaps back to its original position.

A switch of the form illustrated in FIG. 5 has particular application when it is desired to provide simultaneous outputs from a number of circuits all activated by a single switch. Thus for binary code signals the switch of FIG. 5 provides the coded signal simultaneously on all parallel outputs. The switch provides a common contact, contact 24, electrically in series with the encoding contacts so that it is not necessary to provide a time delayed clock signal to read the coded data. This is necessary with other forms of binary coded dials. Also, encoding circuits are eliminated.

In logic circuitry, the data is normally stored and processed in binary form. Existing input devices such as push-button dials and keys present the data in the form of a single contact closure per button or in matrix form such as a 2 out of 8 code. Therefore it is necessary, with existing switches, to provide logic interface circuits to recode the single contact closures in binary form or to transform the 2 out of 8 code into binary before the data can be processed or stored by logic circuitry.

The advantages of the present invention, applied to a switch as in FIG. 5, are 1. Guaranteed simultaneous appearance of the encoding bits of the data at the termials of a multibutton key or dial pad;

2. Reduced costs because of the elimination of time delayed strobing circuits or encoding circuits and a reduction of the number of leads to be connected to the key strip or dial pad;

3. Simple mechanical construction, with low cost of fabrication.

FIG. 8 illustrates a printed circuit board with a printed circuit thereon for a plurality of binary coded push buttons. In FIG. 8 the position of the push-buttons or switches are indicated by the dotted circles 41(*a*) to 41(*j*) respectively, 10 buttons in a 2 + 5 array. Such a push-button switch array is, for example, capable of use in a telephone where the buttons 41(*a*) to 41(*j*) would bear the numbers 1, 2 . . . 8, 9, 0 respectively. Pushing, or depressing, one of the buttons generates a binary code. The contact portions of the printed circuit beneath the push-buttons are connected to output connections 42, 43, 44 and 45, and 46. Outputs 44 and 45 being connected together external to the board 25. A further connection 47 is also provided for a strobe signal. The output 47 is connected to a contact 48 which, when the buttons and other parts are assembled, is in contact with the spring plate 10. All the contacts for all the button positions are formed conveniently in one large contact plate. Contact 48 can be a conductive rubber pellet, conductive epoxy resin, or other means. A contact 49 at the center of each button position — contacted by the central contact 24 for each switch — is connected to a further output connection 50.

The binary code relating to each button and output connection is indicated in Table I.

TABLE I

| | 46 | 44<br>45 | 43 | 42 | 47(STROBE) |
|---|---|---|---|---|---|
| 41(a) | 0 | 0 | 0 | 1 | 1 |
| 41(b) | 0 | 0 | 1 | 0 | 1 |
| 41(c) | 0 | 0 | 1 | 1 | 1 |
| 41(d) | 0 | 1 | 0 | 0 | 1 |
| 41(e) | 0 | 1 | 0 | 1 | 1 |
| 41(f) | 0 | 1 | 1 | 0 | 1 |
| 41(g) | 0 | 1 | 1 | 1 | 1 |
| 41(h) | 1 | 0 | 0 | 0 | 1 |
| 41(i) | 1 | 0 | 0 | 1 | 1 |
| 41(j) | 1 | 0 | 1 | 0 | 1 |

Thus pushing or depressing a button having the number 5 — button 41*e* in FIG. 8 and table I results in the code 0101.

Other arrangements of buttons can be provided and arrangement of buttons, and the code used, can be varied. For example a 3 + 4 array as in a standard telephone can be used or an array suitable for pocket or other forms of calculators. Also the binary code differing from that given in table I can be used.

At each button or switch area there are four principal contact areas 51, 52, 53 and 54, positioned to cooperate with the contacts 12, 13, 14 and 15 of a contact plate as in FIGS. 1 to 4 and FIG. 5. Although only one such contact area need be connected to generate a particular binary digit, it is preferable that all four areas be provided under each button or switch area so that the movement of each contact finger is the same. The redundant contact areas at all the switch positions are connected so that none are left floating, which would make them susceptable to being electrically charged, causing faulty codes, and possibly causing destruction of high impedance circuits. The center contact area 55 are shown connected by a dotted connection 50 to the output connection 50, as referred to above. These connections can conveniently be provided on the underside of the printed circuit boards, for example by plated through holes. The contact areas 51 to 55 are seen in more detail for one switch position in FIG. 8(*a*).

FIG. 9, in combination with FIGS. 5 and 8, illustrates diagrammatically the actuation of the various contacts with FIGS. 10*a* and 10*b* illustrating the improvement of signal outputs. As illustrated in FIG. 9, an input signal is applied via output 50 to the contact position 55 on the printed circuit board contacted by the central contact 24. The contacts 12 to 15 are indicated as connecting to contact areas 51 to 54 respectively, contacts 12 to 15 being in parallel. Contact 24 is in series with the contacts 12 to 15 and it is arranged, as previously described, that contacts 12 to 15 are made before central contact 24. Outputs from contact areas 51 to 54, indicated at 51*a* to 54*a* for convenience, may or may not all exist, the code, distinguishing the buttons in an array, being provided by appropriate selection of the possible combinations of contacts 12*a* to 15*a*. Thus in FIG. 9 no output is indicated for contact area 53. Similarly other connections and related outputs can be omitted. The spring contact plate 10 also makes contact with a terminal on the printed circuit board as previously described to prevent false triggering due to static charges and arcing when contact 24 is broken on release of the push-button. This is indicated diagrammatically in FIG. 9 by connection to ground 56 via a resistor 57.

Considering FIGS. 10*a* and 10*b*, due to manufacturing tolerances making it impossible to align the contact fingers 12 to 15 such that they all make contact simultaneously, then an input, for convenience indicated as applied at 58 would not appear at outputs 51*a* to 54*a* simultaneously because of the differing "make" times of the contacts. This is indicated diagrammatically in FIG. 10*a* which shows the output signals as a function of time appearing on terminals 51*a*, 52*a*, 53*a* and 54*a* if the input signal is applied to the spring contact plate terminal — 47 in FIG. 8 — and hence directly to contacts 12, 13, 14 and 15. As illustrated in FIG. 10*a*, a time spread of nearly $\Delta t$ occurs. The mechanical making of the contacts is indicated by the short vertical lines 59. FIG. 10*a* also indicates the code signal for the arrangement of FIG. 9, in which signals appears at outputs 51*a*, 53*a*, and 54*a* and no signal appears at 52*a* — this output not existing. The binary code output is indicated in FIG. 10*a* at the outputs 51*a* to 54*a*. FIG. 10*b* illustrates the improvement in time relationship of the output signals on terminals 51*a* to 54*a* when the input is applied to terminal 50 — FIG. 8 — and thus delayed by the closure of contact 24 occuring at the time t in FIG. 10*b*. FIGS. 10*a* and 10*b* illustrate what would be seen on an oscilloscope, each of the four traces representing a different output 51, 52, 53 and 54.

With the provision of the central contact 24, which makes after all the other contacts have made, the outputs appear at the outputs 51*a* to 54*a* simultaneously with the closing of contact 24, as indicated in FIG. 10*b*. Additionally, output 58, corresponding to contact 47, provides for an output when any button is depressed, thus providing a strobe function, which is useful in some applications. For example output 58 provides for an all zero's output.

The number of contacts per button can be varied, not of necessity being four, but the number of contacts which can be accommodated under each button is limited. For telephone and similar uses, four contacts are usually sufficient, but in other uses, the number of contacts limits the number of bits, and the number of buttons per array.

However, arrays can be multiplexed by using switches as described above, in respect of FIG. 5 for example, and using simple gates or similar devices. FIG. 11 illustrates one such arrangement for a total of 64 keys with 4 bits per 16 key array.

FIG. 11 illustrates a 64 key binary array. Indicated at 60 is one push button but is it to be understood that this is one push button of a 16 push-button module. Similarly, indicated at 61, 62 and 63 are respectively a single push button of each of three further similar push-button modules. Only one button of each module is indicated for clarity.

Considering first the push button 60, it has four contact areas indicated schematically by references 60*a*, 60*b*, 60*c* and 60*d*. Contacts 60*e*, 60*f*, 60*g*, and 60*h* are also schematically indicated, these contacts corresponding to contacts 12, 13, 14 and 15 in FIGS. 1 to 5. The center contact, indicated at 64 and corresponding to contact 24 in FIGS. 1 to 5, makes contact with a central contact area 65, corresponding to 50 in FIG. 8.

Similarly, for buttons 61, 62 and 63, contact areas are indicated at 61*a*, 61*b*, 61*c* and 61*d*; 62*a*, 62*b*, 62*c*, and 62*d*; and 63*a*, 63*b*, 63*c*, and 63*d* respectively with contacts indicated at 61*e*, 61*f*, 61*g*, and 61*h*; 62*e*, 62*f*, 62*g*, and 62*h*; and 63*e*, 63*f*, 63*g* and 63*h* respectively. The center contacts on the spring contact plates are indicated at 66, 67 and 68 respectively and the entire contact areas at 69, 70 and 71 respectively.

Again considering the first push-button module, indicated at 60, the contact areas 60*a*, 60*b*, 60*c* and 60*d* are selectively connected to output busses 75, 76, 77 and 78 in accordance with the required code. Thus, in FIG. 11, connections are shown from all contact areas 60*a*–*d*, 61*a*–*d*, 62*a*–*d* and 63*a*–*d*. However not all such connections need exist. Similarly, in the push button module at the position indicated at 60 it should be appreciated that only one button or switch of a 16 button module is indicated and the connections between contact areas and busses can vary for each of the 16 buttons or switches. The same situation occurs for each 16 button module associated with the push buttons indicated at 61, 62 and 63. Two additional output busses are provided at 79 and 80. To obtain a non-zero output when button 0 is depressed, a separate output — 81 and labelled "strobe" — is provided.

To provide for the additional 16 button arrays at button positions 61, 62 and 63, the spring contact plates are connected at 85 and 88 to buss 79 via diode 86 and 90 respectively and at 87 and 88 to buss 80 via diodes 89 and 90*a* respectively. This provides that when any button in the 16 button module at position 61 is depressed a logic 1 appears on buss 79, any button depressed in the module at 62 produces a logic 1 on buss 80 and any button depressed on the module at 63 produces a logic 1 on busses 79 and 80.

An input buss is indicated at 91 and the contact plates are also connected to a ground buss 92, via resistors 93, to prevent static charges.

Thus, while the number of contacts available for encoding under each button has been shown as limited to four — considered as optimum for practical reasons, the array can be expanded at will by the provision of connections 85, 86 and 87, extra busses 79 and 80 and diodes or gates 86, 89 and 90. If increased to 128 buttons there would be 12 diodes, or gates. In such a circumstance it could prove more practical to use three 4 — input OR gates instead.

The printed circuit board which provides the encoding of the contacts and interconnections to the busses can be designed using standard printed circuit board layout techniques and manufactured by standard printed circuit board processes.

What is claimed is:

1. A multiple pushbutton switch comprising:

a flat spring plate having a plurality of integral switch positions thereon;

each switch position comprising a prestressed domed portion extending upwardly from said flat spring plate and completely surrounded by a flat portion of said flat spring plate, said flat portion circumferentially constraining said domed portion, said domed portion including a center portion and a plurality of radial webs connecting said center portion and said portion of said flat spring plate surrounding the domed portion and integral therewith, each radial web having an upwardly bent portion at its junction with said portion of said flat spring plate, said webs radially constrained by said flat portion of said spring plate;

a central contact on said centre portion;

a plurality of cantilevered spring contact members extending from said center portion, a contact member between each pair of radial webs and extending a radial distance less than said radial webs;

each spring contact member extending radially outward from said center portion and downwardly therefrom and including a contact area at a radially outwards end thereof;

a circuit member positioned below and spaced from said flat spring plate and including contact areas on said circuit member beneath said spring contacts and a further contact area on said circuit member beneath each central contact;

a plurality of pushbuttons mounted above said flat spring plate, a button over each domed portion to apply a downward force on the related center portion each said domed portion, on application of said downward force, arranged to snap downward towards said circuit member and to bend each of said webs adjacent to and radially inward of said upwardly bent portion to produce a return force on said domed portion;

said contact areas on said spring contact members at each switch position extending below the related central contact, to make contact with said contact areas on said circuit board beneath said spring contacts before said central contact makes contact with said further contact area on said circuit board, on application of said downward force on said center portion.

2. A push button switch as claimed in claim 1, including a cover member extending over said spring contact plate and a plurality of apertures in said cover, an aperture for each push-button, and interengaging formations on said cover and each of said buttons to retain said push-buttons in position.

3. A push button switch as claimed in claim 2, for a binary coded signal system, each of said contact areas having a predetermined contact configuration to produce a predetermined binary code on depression of a related push-button.

* * * * *